US006015972A

United States Patent [19]

Hager

[11] Patent Number: 6,015,972

[45] Date of Patent: Jan. 18, 2000

[54] BOUNDARY ACTIVATED DISSOCIATION IN ROD-TYPE MASS SPECTROMETER

[75] Inventor: James W. Hager, Mississauga, Canada

[73] Assignee: MDS Inc., Etobicoke, Canada

[21] Appl. No.: 09/084,778

[22] Filed: May 27, 1998

Related U.S. Application Data

[60] Provisional application No. 60/071,231, Jan. 12, 1998.

[51] Int. Cl.[7] ..... H01J 49/42

[52] U.S. Cl. ..... 250/282; 250/292

[58] Field of Search ..... 250/282, 292, 250/290

[56] References Cited

U.S. PATENT DOCUMENTS

| | | | |
|---|---|---|---|
| 4,137,750 | 2/1979 | French et al. | 73/23 |
| 4,963,736 | 10/1990 | Douglas et al. | 250/292 |
| 5,089,703 | 2/1992 | Schoen et al. | 250/292 |
| 5,248,875 | 9/1993 | Douglas et al. | 250/282 |
| 5,378,891 | 1/1995 | March et al. | 250/282 |

FOREIGN PATENT DOCUMENTS 0 630 041 A2 12/1994 European Pat. Off. .

OTHER PUBLICATIONS

"A New Technique for Decomposition of Selected Ions in Molecule Ion Reactor Coupled with Ortho–Time–of–flight Mass Spectrometry", Rapid Commun. Mass Spectrom,11, 1649–1656 (1977).

Mingda Wang, Steve Schachterle, and Greg Wells, "Application of Nonresonance Excitation to Ion Trap Tandem Mass Spectrometry and Selected Ejection Chemical Ionization", pp. 668–676, Mar. 7, 1996.

Gholamreza Javahery and Bruce Thomson, "A Segmented Radiofrequency–Only Quadrupole Collision Cell for Measurements of Ion Collision Cross Section on a Triple Quadrupole Mass Spectrometer", pp. 697–702, Mar. 6, 1997.

Bruce A. Thomson, D.J. Douglas, Jay Corr, James Hager, and Charles Joliffe, "Improved Collisionally Activated Dissociation Efficiency and Mass Resolution on a Triple Quadrupole Mass Spectrometer System", pp. 1696–1704, May 15, 1995.

*Primary Examiner*—Kiet T. Nguyen
*Attorney, Agent, or Firm*—Bereskin & Parr

[57] ABSTRACT

The method of operating a rod-type mass spectrometer in which precursor ions are introduced into the mass spectrometer together with a collision gas. Sufficient RF voltage, and a small but sufficient amount of resolving DC voltage, are applied to the rods to operate the mass spectrometer near the $\beta=0$ boundary for the precursor ions, thus inducing boundary activated dissociation of at least some of the precursor ions to produce fragment ions. The fragment ions together with any residual precursor ions are directed into a subsequent mass spectrometer for detection and analysis. The method allows moderate mass resolution of the precursor ion which can be used to obtain MSMS information from a single quadrupole and $MS^3$ information from a triple quadrupole. When the DC is scanned over only part of the spectrum, fragmentation information can be obtained within a prespecified region of the spectrum, and the remainder of the spectrum will display spectral features of unfragmented precursor ions. The method can also be used in the collision cell of a triple quadrupole mass spectrometer, allowing shorter collision cells and cost reduction. The method can also be used to provide efficient declustering of heavily clustered precursor ions of the kind commonly produced by electrospray and ion spray ionization techniques.

9 Claims, 12 Drawing Sheets

DC DAC = 0.000 @ 600. RNG=0V et al.: 10ng/uL reserpine solution.

myo-DAC @ 1000 = 0.00 low int et al.: std myoglobin solution with low OR/SK?FR voltages Info for pane 1: linear DAC @ 600 = -4.000 (No Title)
Period 1, Expt 1; Mass range: 350.0 to 620.0 by 0.1 amu; Dwell: 1.0 ms; Pause: 5.0 ms

BOUNDARY ACTIVATED DISSOCIATION IN ROD-TYPE MASS SPECTROMETER

RELATED APPLICATION

This invention claims the benefit of provisional application Ser. No. 60/071,231 filed Jan. 12, 1998 entitled "Boundary Activated Dissociation In Rod-Type Mass Spectrometer".

FIELD OF THE INVENTION

This invention relates to boundary activated collision induced dissociation in a high pressure rod-type mass spectrometer.

BACKGROUND OF THE INVENTION

Ion structural information can be obtained from the fragmentation of a polyatomic ion following an energetic collision. Usually triple quadrupole mass spectrometers are used to generate such ion structural information through MS/MS techniques. The basic instrumentation required to obtain such information consists of two quadrupole mass spectrometers separated by a collision cell (commonly referred to as a triple quadrupole since the collision cell also includes a set of quadrupole rods). The first mass spectrometer selects the first precursor ion of interest, which ion is then directed with a specified energy into the pressurized collision cell. In the collision cell, collision induced dissociation (CID) occurs, producing a number of product ions. The mass to charge ratios of the product ions, as well as that of the residual precursor ion, are measured with the second resolving mass spectrometer.

RF-only quadrupoles have been used for some time as efficient containment devices for product ions formed by CID of activated precursor ions. Typically ion activation is accomplished by operating the RF-only quadrupole at pressures of up to 10 milliTorr, and introducing the precursor ions at laboratory reference frame energies of tens to hundreds of electron volts. Activation in this way is efficient (since the collision energies are sufficient readily to fragment the precursor ions) and, coupled with the high containment characteristics of the RF-only collision cell, can provide high CID product yields.

Triple quadrupole mass spectrometers perform MS/MS scans on a continuous ion beam in spatially separated segments of the instrument. This contrasts with ion trap mass spectrometers, where a pulse of ions is introduced into the containment volume of the mass spectrometer; a precursor ion mass-to-charge ratio is selected and isolated in the volume, collisional activation is induced (usually by using a supplementary RF voltage), and then product ion analysis is performed, all within the same volume but in time sequence. Of course, in the product ion analysis, the product ions are sequentially scanned out of the device and are detected using conventional means. The ion trap also allows for additional stages of fragmentation and product ion identification, and thus allows for $MS^n$ experiments, which are not currently possible employing conventional rod type triple quadrupole mass spectrometers. As mentioned, in contrast to the spatially separated segments of a triple quadrupole mass spectrometer, the steps leading to the generation of a product ion spectrum in an ion trap are separated in time rather than in space.

Collisional activation in an ion trap mass spectrometer is different from that in a triple quadrupole mass spectrometer. In the latter, the precursor ion is accelerated from a relatively low pressure region of the instrument into a much higher pressure region, where the first few collisions (which are energetic) cause fragmentation. Collisional cooling reduces the energy of later collisions so that they do not normally cause fragmentation. In contrast, in an ion trap mass spectrometer the selected precursor ion is usually activated by means of a resonance process (resonance excitation) resulting in numerous low energy collisions. In this case the activation process is step-wise, since the presence of the buffer gas (usually helium) prevents the precursor ions from attaining high kinetic energies between collisions. Thus, numerous low energy collisions (with energy added between the collisions by the resonance excitation) are required to reach the threshold energy of fragmentation.

An alternative to resonance excitation for collisional activation in an ion trap is to properly choose the "a" and "q" value of the precursor ion such that the working point is brought near a boundary of the a-q stability diagram. At this point, the amplitude of the ion oscillations in the ion trap increases, and higher energy collisions of the ion with the background gas are effected. This technique, referred to as "boundary activated dissociation", has been found to deposit sufficient energy into the precursor ion to promote efficient fragmentation. It is thought that boundary activated dissociation, like dissociation caused by resonance excitation, also occurs via a step-wise mechanism.

BRIEF SUMMARY OF THE INVENTION

The present invention involves a method to enhance the fragmentation efficiency within a high pressure rod type quadrupole device using boundary activated dissociation. In one of its aspects the invention provides a method of operating a rod type mass spectrometer comprising: introducing precursor ions into said mass spectrometer, providing a collision gas therein to limit the mean free path of said precursor ions, and applying RF and resolving DC voltages to said mass spectrometer to operate said mass spectrometer near the $\beta=0$ boundary for said precursor ions, thereby inducing boundary activated dissociation of at least some of said precursor ions to produce fragment ions, and detecting at least some of said fragment ions.

Further objects and advantages of the invention will appear from the following description, taken together with the accompanying drawings.

DETAILED DESCRIPTION OF PREFERRED EMBODIMENTS

Figure 1:
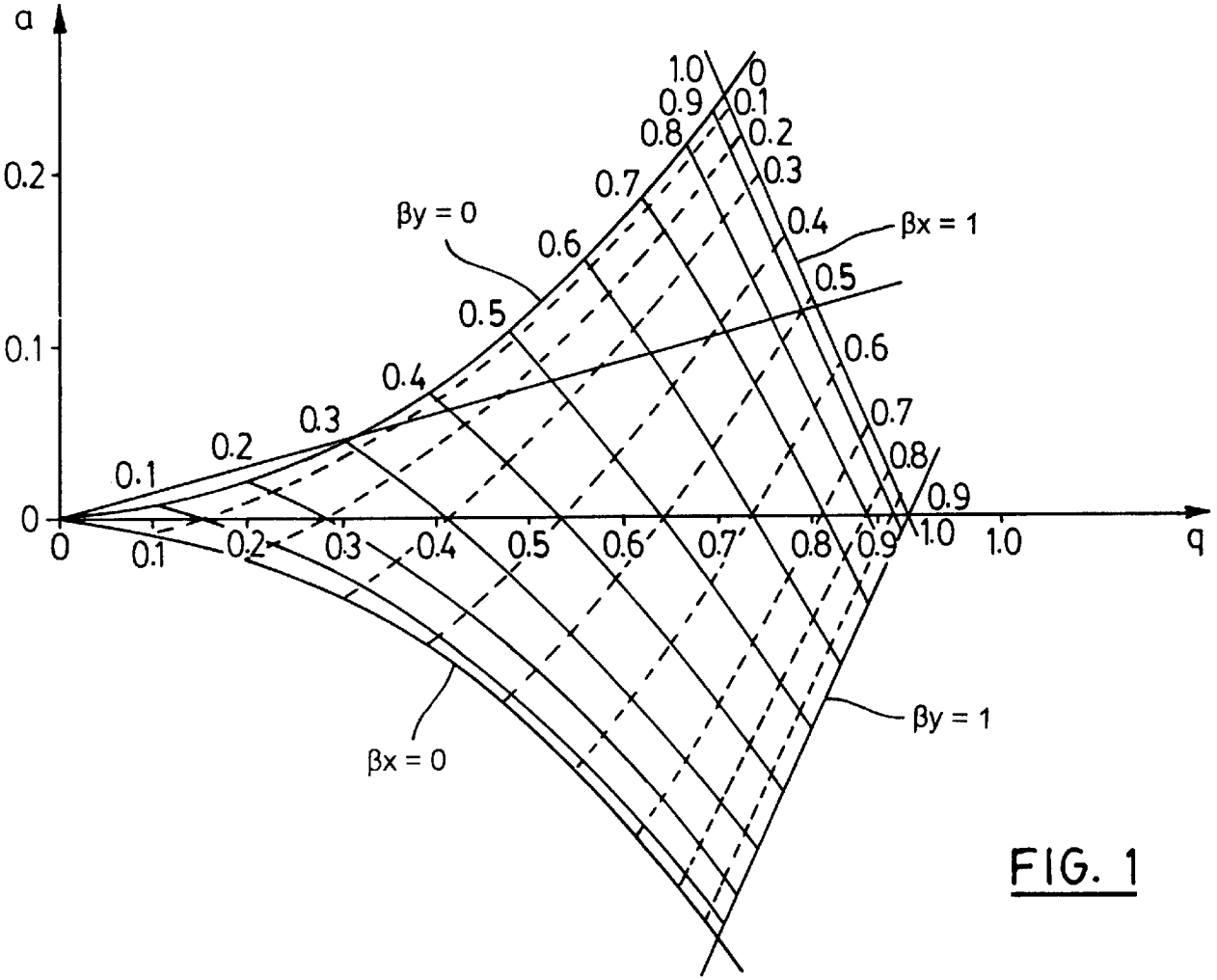
FIG. 1 is a graph showing the well known operating diagram of a quadrupole mass spectrometer.

Reference is first made to FIG. 1, which shows the well known operating diagram for a quadrupole mass spectrometer, with the parameter "a" plotted on the vertical axis and the parameter "q" on the horizontal axis. As is well known, the Mathieu parameters are:

$$a_x=-a_y=8zU/(m\Omega^2 r_0^2) \quad (1)$$

$$q_x=-q_y=4zV/(m\Omega^2 r_0^2) \quad (2)$$

where U is the amplitude of the DC voltage applied to the rods, V is the amplitude of the RF voltage applied to the rods, z is the number of charges on the ion, m is the ion's mass, Ω is the RF frequency, $r_0$ is the inscribed radius of the rod set, and the subscripts x and y refer to the two pairs of quadrupole rods. When the applied DC voltage is zero, the "a" value in the above equations is also zero, and the device is considered to be operating in the radio frequency only (RF-only) mode. A typical operating line is indicated at 10 in FIG. 1. In the RF-only mode, the operating line 10 would be along the "q" axis.

RF-only quadrupoles are often used to transport ions from high pressure ion sources to a mass analyzer while gas from the source is pumped away through the rods. U.S. Pat. No. 4,963,736 teaches that when the RF-only quadrupole ion guide is operated at a chamber pressure-times-rod set length which is greater than $2.25\times10^{-2}$ torr cm, extremely efficient ion transport results. The above pressure-times-length regime leads to the ions being forced toward the center line of the quadrupole due to a collisional focusing or damping effect. At the same time, the ions lose a significant amount of their entrance axial energy and undergo a reduction in ion energy distribution. The reduction in energy distribution results in enhanced mass spectral resolution in subsequent resolving quadrupole mass spectrometers.

It has been found according to the present invention that efficient precursor ion fragmentation can be effected within a high pressure rod type, nominally RF-only, quadrupole by moving the working point near the β=0 boundary of the stability diagram. As shown in FIG. 1, the top left quadrant above the $\beta_y=0$ line represents an area in which the radial motion of the ions along the x-pole pair is stable, but that along the y-pole pair is unstable and the ions leave the rods (or hit the rods) in the y-pole pair direction. In the top right quadrant outside the β=1 line, the y motion is stable but the ions are unstable in the x-pole pair direction. For the lower two quadrants, the stable and unstable trajectories are reversed.

As is well known, β is given by the equation $$\beta_x = (a^2 \pm q^2/2)^{\frac{1}{2}} \quad (3)$$

Equation (3) above is an approximate relationship and is most accurate for "q"<about 0.4, which is the region in which it is proposed to operate.

As the stability boundary β=0 is approached, the ion trajectories begin to exhibit higher amplitude motion. If the energy deposited into the precursor ion via collisions with background gas species is sufficient, fragmentation results, leading to dissociation products. The probability of collision with a background neutral species depends on the mean free path of the ion within the quadrupole. The mean free path λ is defined as $$\lambda = \frac{1}{(n\sigma)} \quad (4)$$

where n is the neutral gas number density and δ is the collision cross section of the ion. If the mean free path is larger than the $r_0$ value (i.e. the inscribed radius of the rods), then it is likely that the trajectory of the precursor ion will continue to grow and the ion will be lost to rods prior to experiencing an activating collision. Typical collision cross sections for ions from an electrospray source range from approximately 100 $A^2$ to more than several thousand $A^2$ (G. Javahery and B. Thomson, *J. Am Soc Mass Spectrom* 8, 697–702(1997)). The $r_0$ value for a typical RF-only quadrupole is 4.17 mm. For an ion with a collision cross-section of approximately 100 $A^2$ to experience an average of one collision before travelling the distance of 4.17 mm from the center line of the quadrupole to a rod surface, the pressure must be greater than $7.6\times10^3$ torr. Below this pressure, a precursor ion with a collision cross section of about 100 $A^2$ will likely be lost from the quadrupole prior to encountering a neutral collision partner.

A further requirement for fragmentation is that sufficient energy be deposited into the precursor ion. Since, in boundary activated dissociation, it is the energy from the RF drive potential that leads to ion acceleration into the coexisting neutral atoms or molecules in the device, a measure of the energy deposition can be obtained from the Mathieu "q" parameter. The greater the "q" value for the precursor ion, the greater the ion acceleration between collisions, and the larger is the resulting energy deposition.

Another approach in estimating the collision energy can be made using the radial confinement forces within a quadrupole. For a "q" value of less than about 0.4, a pseudo-potential well depth, D, can be defined as:

$$D \cong \frac{qV}{8} \tag{5}$$

The well depth can be considered physically to be an approximation of how tightly the ions are bound along a certain dimension, e.g. radially, in terms of volts. For example, the ions may need approximately 18 volts of energy to move radially out of the RF confinement field. It may also be considered physically to be a measure of the amount of energy available from the RF field for fragmentation.

Application of a DC voltage will contribute further to the pseudo-potential well depth, but the DC will not be explicitly considered here. Thus, the maximum kinetic energy in the radial direction can then be approximated to be $$E_{kin}=zD \tag{6}$$

where as mentioned z is the number of charges on the ion. The average energy is approximately half of the maximum energy and is thus $$E_{avg} = \left(\frac{4}{\pi^2}\right)zD \tag{7}$$

As an example, consider the situation of a singly charged positive ion for which m=609

$r_0$=0.417 cm

Ω=1.000 MHz

V=400 volts

From these values, the q value is calculated to be 0.37, and the radial pseudo-potential well depth from the RF field is 18.5 volts. The amount of added DC required to move the working point to the β=0 boundary can be approximated by solving equation (3) above for "a" and then putting the value into equation (1) and solving for U, yielding about −37 volts.

Figure 2:
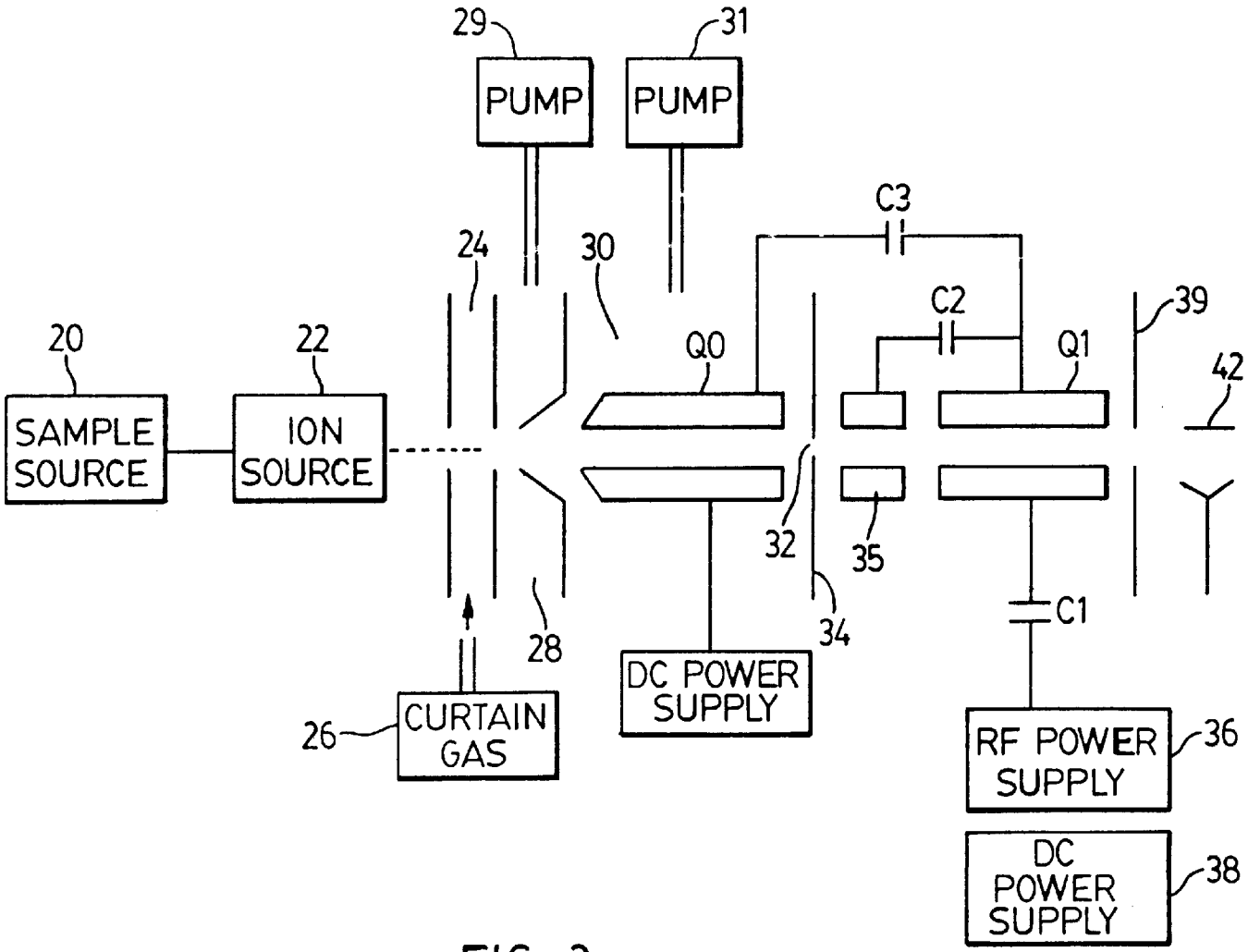
FIG. 2 is a diagrammatic view of conventional apparatus which can be used to practice the present invention.

Apparatus used to achieve boundary activated dissociation is shown in FIG. 2, in which a mass spectrometer with a high pressure RF-only quadrupole ion guide is illustrated. In the FIG. 2 apparatus, a sample source 20 supplies sample (typically in liquid form) to an ion source 22 (which may be of any suitable form but is typically an electrospray or ion spray source). Source 22 produces ions from the sample and directs them into an interface region 24 which may be supplied with inert curtain gas from curtain gas source 26, as shown in U.S. Pat. No. 4,137,750. Ions passing through the curtain gas (which may be $N_2$) travel through a differentially pumped region 28, pumped by pump 29 to a pressure of about 2 torr, and enter a 20 cm long quadrupole RF-only rod set Q0 in chamber 30, which is pumped by pump 31 to a pressure of about $8\times10^{-3}$ torr. The pressure-times-length of this RF-only device is $1.6\times10^{-1}$ torr cm and thus falls within the regime taught in U.S. Pat. No. 4,963,736. The buffer gas in rod set Q0 will be the same species as that used for the curtain gas, in this example $N_2$.

From chamber 30, the ions travel through an orifice 32 in an interface plate 34 and through a set of 24 mm long RF-only rods 35 into a 20 cm long set of analyzing quadrupole rods Q1. The RF-only rods 35 serve to collimate the ions travelling into the analyzing quadrupole Q1. A conventional detector 42 operated in the pulse counting mode is placed downstream of analyzing rods Q1. This apparatus as described is relatively conventional and can produce a mass spectrum as the RF and DC on the analyzing rods Q1 are scanned.

Analyzing rods Q1 are supplied with RF at 0.816 MHz through capacitor C1 from RF power supply 36. The same RF is supplied through capacitors C2, C3 to rods 35 and Q0 respectively. The capability also exists to supply low levels of resolving DC to the Q0 rods from DC power supply 38. Conventional DC offsets are also applied to the various rods and to the interface plates from the DC power supply 38.

Figure 3:
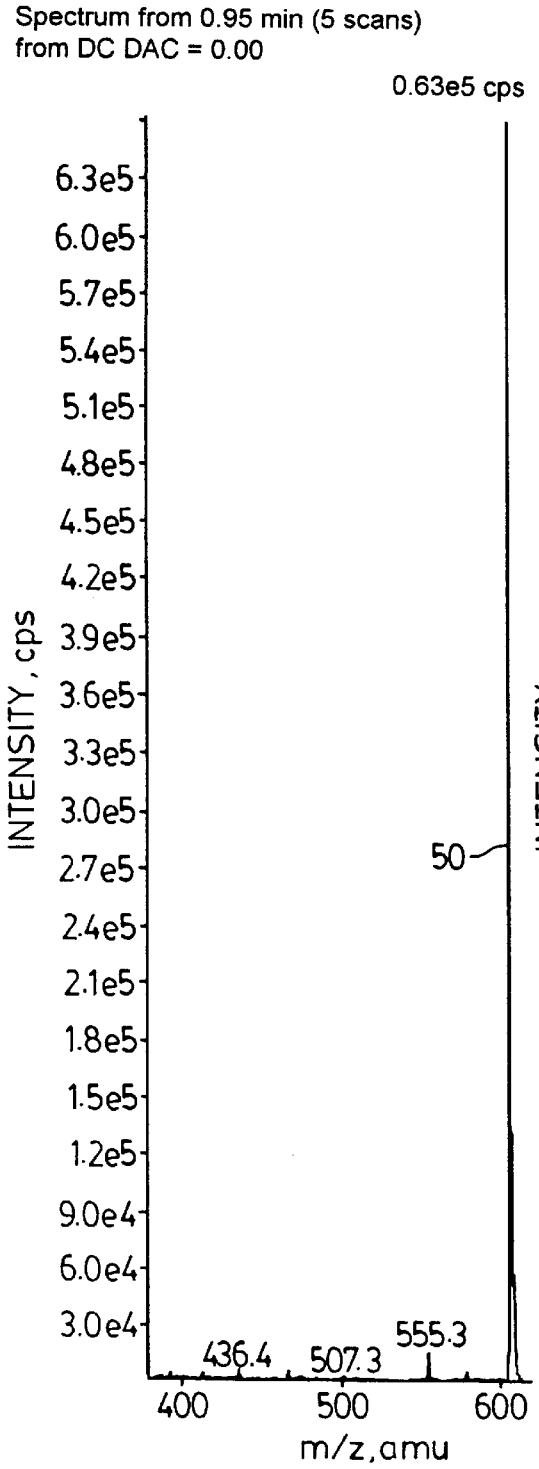
FIG. 3 shows a mass spectrum obtained with no resolving DC on the Q0 rods.
Figure 4:
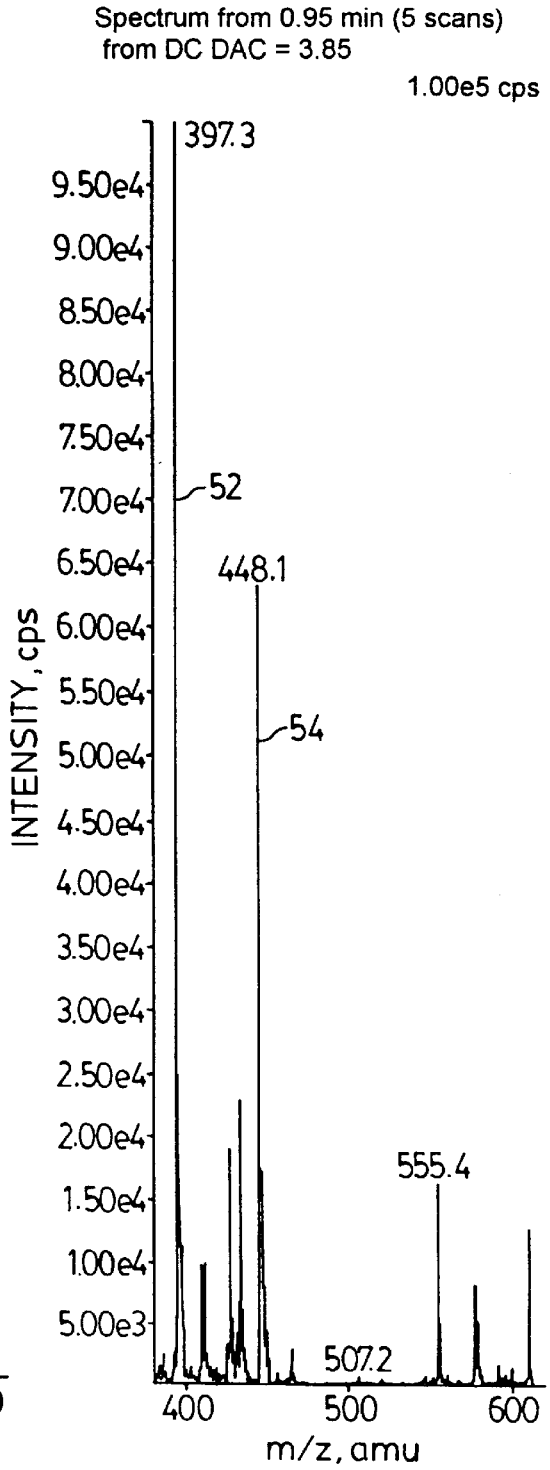
FIG. 4 shows a mass spectrum obtained with a resolving DC voltage applied to the Q0 rods to produce boundary activated dissociation.
Figure 5A:
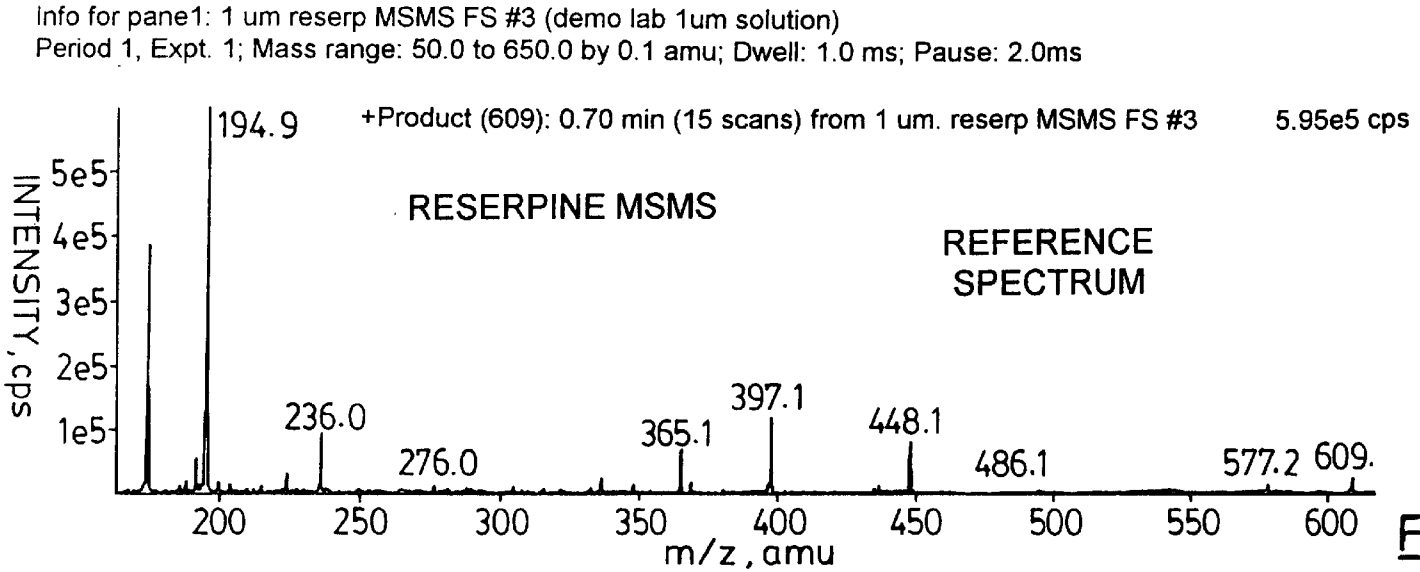
FIG. 5*a* shows a mass spectrum obtained with the use of a conventional triple quadrupole mass spectrometer having a collision cell.
Figure 5B:
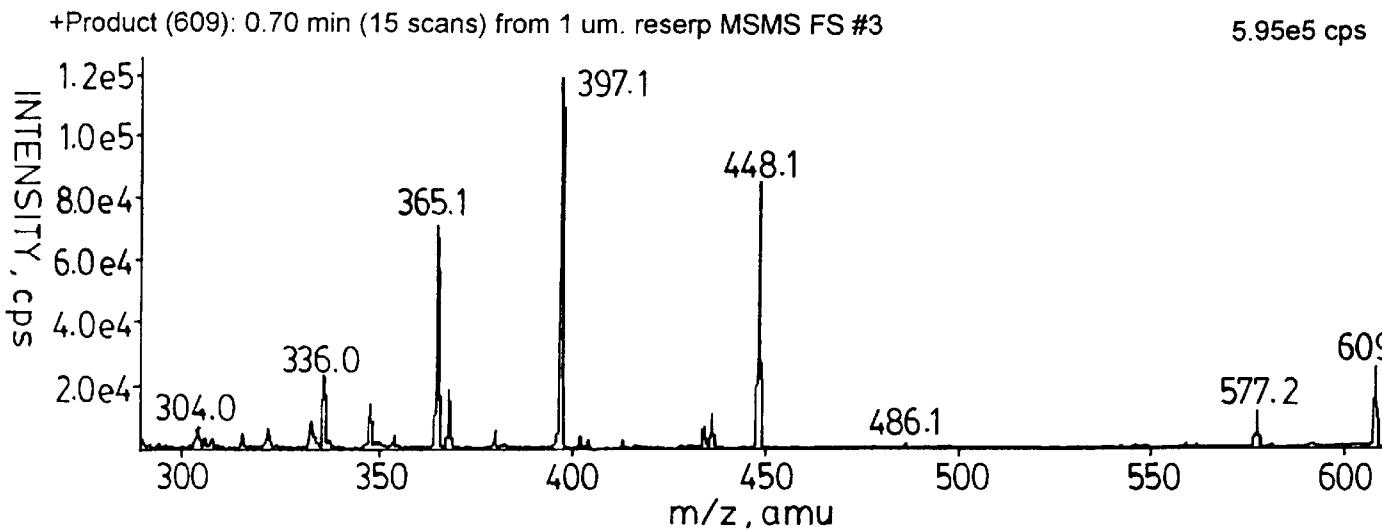
FIG. 5*b* shows in more detail a portion of the mass spectrum of FIG. 5*a;*

An example of a mass spectrum (obtained from the FIG. 2 apparatus) of a 10 ng/μL solution of reserpine is shown in FIG. 3 and was obtained with no resolving DC on the Q0 rods. Apart from a few spectral peaks from impurities in the solution, the spectrum is completely dominated by the $(M+H)^{1+}$ reserpine ion at mass-to-charge ratio 609.4, indicated at reference 50 in FIG. 3. However as shown in FIG. 4, the spectrum changes dramatically when resolving DC is applied to the Q0 rods. Here the resolving DC was linearly ramped from 0 V at m/z 30 to 40.8 V at m/z 600. Shown in FIG. 4 are new spectral features at m/z values of 397.3 and 448.1 (peaks 52, 54 in FIG. 4). These peaks are in good agreement with some of the major fragment ions seen in the conventional (i.e. axially) collisionally activated dissociation spectrum of the m/z 609 reserpine precursor ion as can be seen from the conventional triple quadrupole MS/MS spectrum of reserpine displayed in FIGS. 5*a*, 5*b*. (FIG. 5*a* shows a conventional mass spectrum for reserpine, while FIG. 5*b* is simply a "blow-up" or enlargement of a portion of the FIG. 5*a* spectrum.) It will be noticed that the low mass product ions shown in FIG. 5 are not present in FIG. 4. The reason for this is discussed below.

As discussed above in the description of the apparatus shown in FIG. 2, the RF applied to Q0 is derived from the main RF applied to Q1 through a capacitive divider network. Thus the RF voltage level on Q0 linearly follows the drive RF applied to Q1. Consequently, in order to observe a particular fragment ion, the RF and DC voltages applied to Q0 when Q1 is tuned to transmit the fragment ion must correspond to the RF and DC voltages sufficient to lead to fragmentation of the parent ion. For the experimental conditions used to obtain the spectrum in FIG. 4, the Q0 RF voltage when Q1 was tuned to m/z 397 was 319 V zero to peak ($V_{0-p}$), and the Q0 DC was −27 V. The associated Mathieu parameters for the m/z 609 precursor ion under these conditions are a =−0.075 and q=0.442. This gives a pseudo-potential well depth of about 18 volts.

Thomson et al. (B. A. Thomson, D. J. Douglas, J. J. Corr, J. W. Hager, and C. L. Jolliffe, *Anal. Chem.* 34, 1696–1704 (1995)) have shown that for reserpine fragmentation in a triple quadrupole mass spectrometer, the fragmentation threshold for fragmentation is about 10 eV and complete fragmentation of the m/z 609 precursor ion occurs at collision energies of approximately 35 eV.

It should be recalled that as noted, the activation mechanisms are much different for a conventional triple quadrupole instrument and the boundary activation technique in a high pressure linear quadrupole. Energy deposition in the triple quadrupole arises from a single to a few relatively high energy collisions while the boundary activation method deposits energy into the precursor ion via numerous lower energy collisions. Also, one must consider the fact that there will also be momentum dissipating collisions (collisional cooling) occurring simultaneously with the boundary activating collisions within the high pressure linear quadrupole.

Thus, it is not possible to make a direct correlation between fragmentation thresholds measured in a triple quadrupole mass spectrometer with those obtained via the boundary activation technique, however, an order of magnitude comparison is useful.

Confirmation that the strength of the radial RF confinement field is key to the observation of boundary activated dissociation was obtained by reducing the RF voltage to Q0. This was accomplished by reducing the value of the coupling capacitors C3 in FIG. 2 from the Q1 drive RF from the 2 nF used above, to 148 pF. Under these conditions, the Q0 RF voltage when Q1 was tuned to m/z 397 was 179 $V_{0-p}$ and q=0.248 and a pseudo-potential well depth was approximately 6 volts. Under these conditions no CID product ions were observed, even though DC resolving voltages in the range from about 1 to 30 volts were applied.

It will thus be realized that the energy for boundary activated dissociation is derived from the RF field itself. The well depth D is a measure of the energy available. As the RF voltage increases, the well depth becomes deeper and more energy becomes available to dissociate the ions. Since the well depth D is proportional to $V^2$, if V is increased, D becomes deeper quickly. In effect, the ions are continually pumped with energy from the RF field, so that unlike the case of the collision cell in a conventional triple quadrupole, where the first collision is most energetic and subsequent collisions are much less energetic, in the case of boundary activated dissociation, the second or third collision can be more energetic than the first, continually depositing energy into the ions until they fragment.

Figure 6:
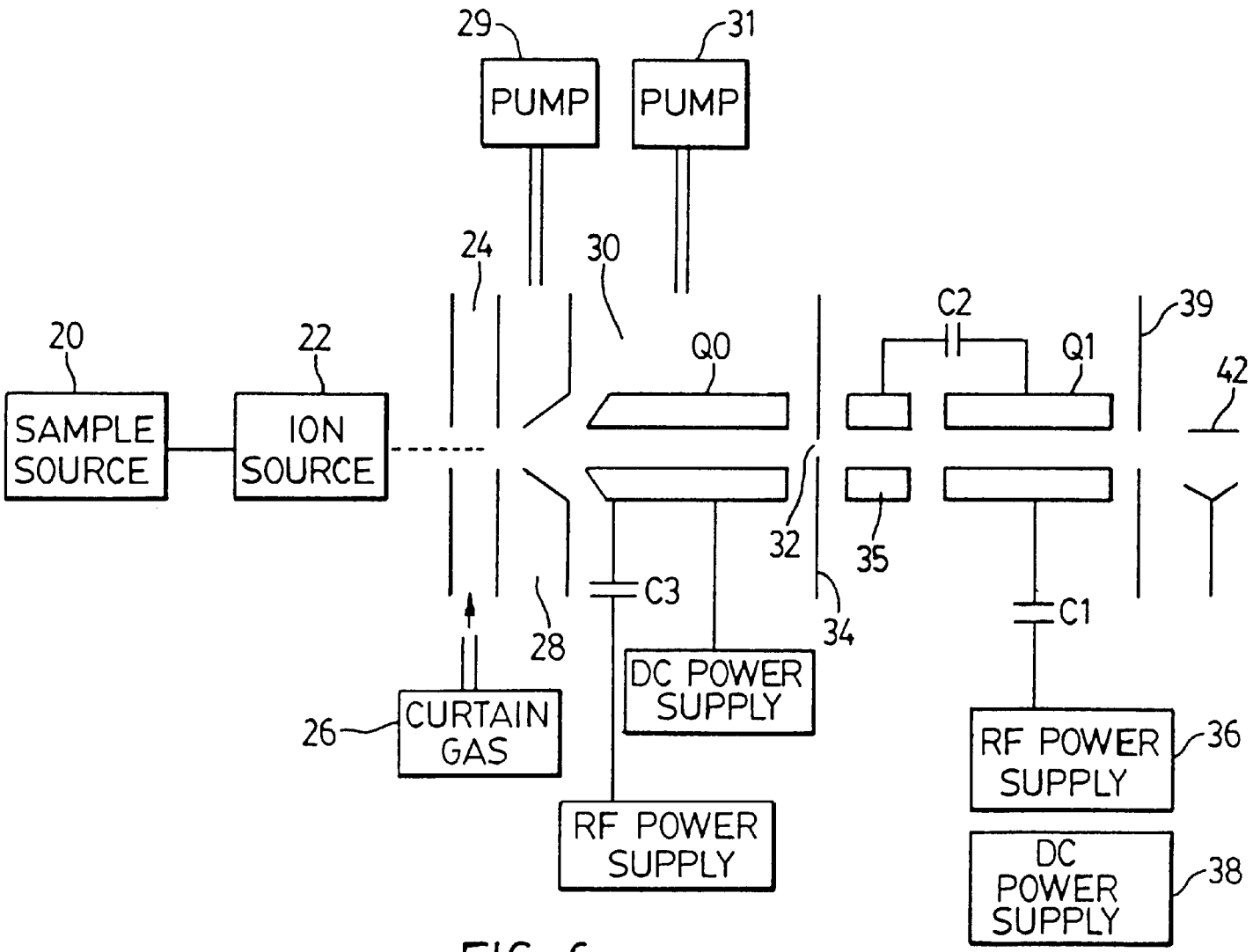
FIG. 6 shows a modification of the apparatus of FIG. 2.

The problem of differing RF field strengths for different product ions described above can be overcome very simply, by driving the Q0 RF voltage independently of the Q1 RF voltage. Such an apparatus is schematically illustrated in FIG. 6, where corresponding reference numerals indicate parts corresponding to FIG. 2. As shown, a separate RF power supply 43 is provided for rods Q0. Appropriate choice of the RF voltage and frequency applied to Q0 using power supply 43 will allow efficient fragmentation of a given precursor ion and transmission of most product ions (those of lower m/z ratio than the precursor ion) into a subsequent mass spectrometer (e.g. Q1) for identification. For example, if the Q0 RF is supplied at a frequency of 2 MHz and a pseudo-potential well depth of approximately 20 V is desired, then an RF voltage of 832.5 V is required from power supply 43. The associated DC resolving voltage required to move the working point to the β=0 stability boundary is 39.9 V. Under these conditions, where the Q0 RF and DC are fixed, product ions down to approximately m/z 146, or 24% of the precursor ion mass-to-charge ratio, will theoretically be stable within Q0. This will allow observation of all the major product ions in the entire reserpine fragmentation spectrum.

Fragmentation efficiency is defined as $$E_F = \frac{(P + \Sigma F_i)}{(P_0)} \tag{8}$$

where $\Sigma F_i$ is the sum of all of the fragment ion intensities, P is the intensity of the residual precursor ion, and $P_0$ is the precursor ion intensity under conditions in which fragmentation does not take place (here this is for no resolving DC voltage applied to Q0). Some of the required information for the fragmentation efficiency can be obtained from the spectra in FIGS. 3 and 4. The integrated ion intensity in FIG. 3 for the precursor ion under conditions where fragmentation does not take place is about $6.9\times10^6$ ion counts/sec. The integrated ion intensities for the reserpine product and residual precursor ions is $3.6\times10^6$ ion counts/sec. Thus the calculated fragmentation efficiency is 52%. However this calculation underestimates the true efficiency because the product ions below m/z~250 are not observed in the spectrum. Since these product ions are expected to have approximately equal intensities as the product ions above the m/z~250 cut-off, a more accurate fragmentation efficiency estimate is close to 100%. This can be compared to an efficiency of 48% determined from triple quadrupole MS/MS experiments.

One important point to note about boundary activated dissociation at the β=0 stability line is that only product ions of lower m/z than the precursor ion will be stable within Q0. Charge reduced product ions will be inherently unstable within Q0 since β<0 for these species. For example fragmentation of a doubly charged precursor ion such as are often formed from electrospray ionization of peptides will only yield doubly charged fragment ions in the product ion mass spectrum obtained using boundary activated dissociation. This offers a unique way of simplifying the product ion mass spectrum of multiply charged precursor ions by discriminating against chosen fragmentation pathways.

Figure 7:
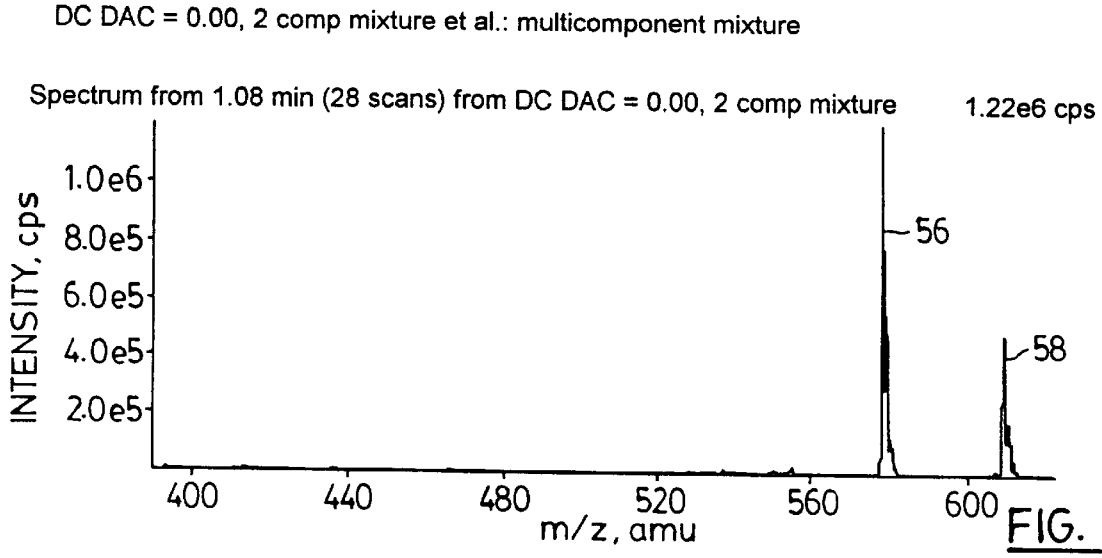
FIG. 7 shows a mass spectrum of a mixture of two substances obtained with no resolving DC applied to the Q0 rods.
Figure 8:
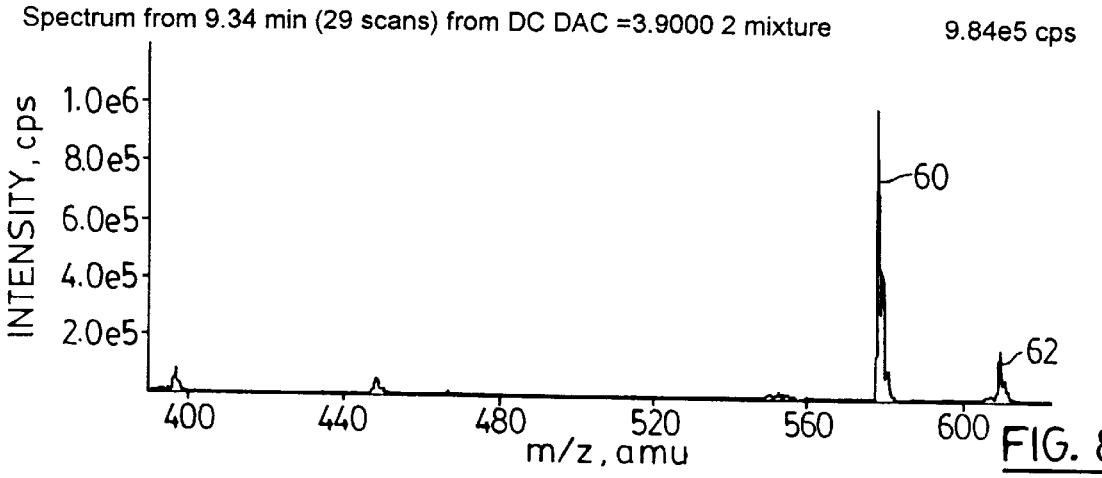
FIG. 8 shows a spectrum of the same mixture as FIG. 7 but with a linearly ramped resolving DC applied to the Q0 rods to produce boundary activated dissociation.
Figure 9:
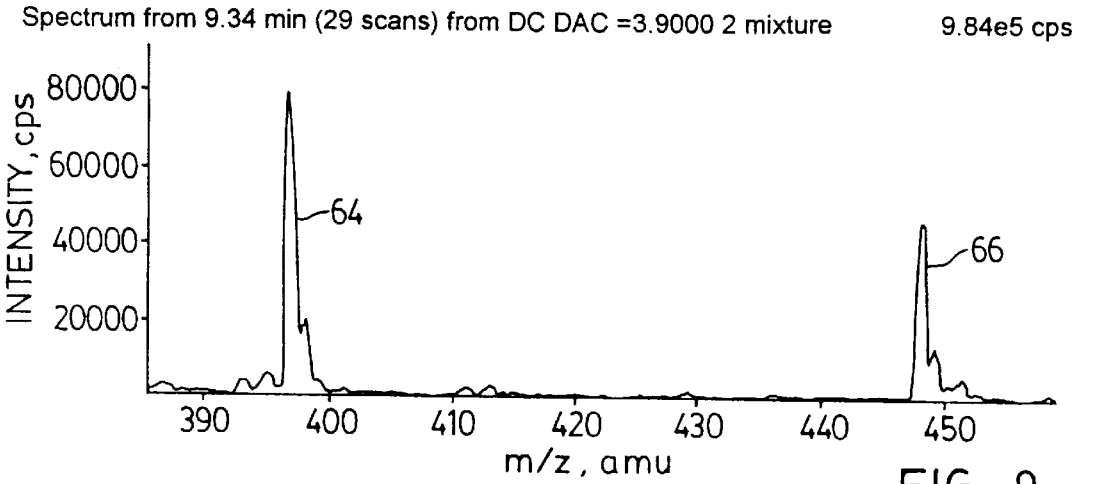
FIG. 9 is a spectrum similar to that of FIG. 8 but with emphasis on a different portion of the mass range.
Figure 10:
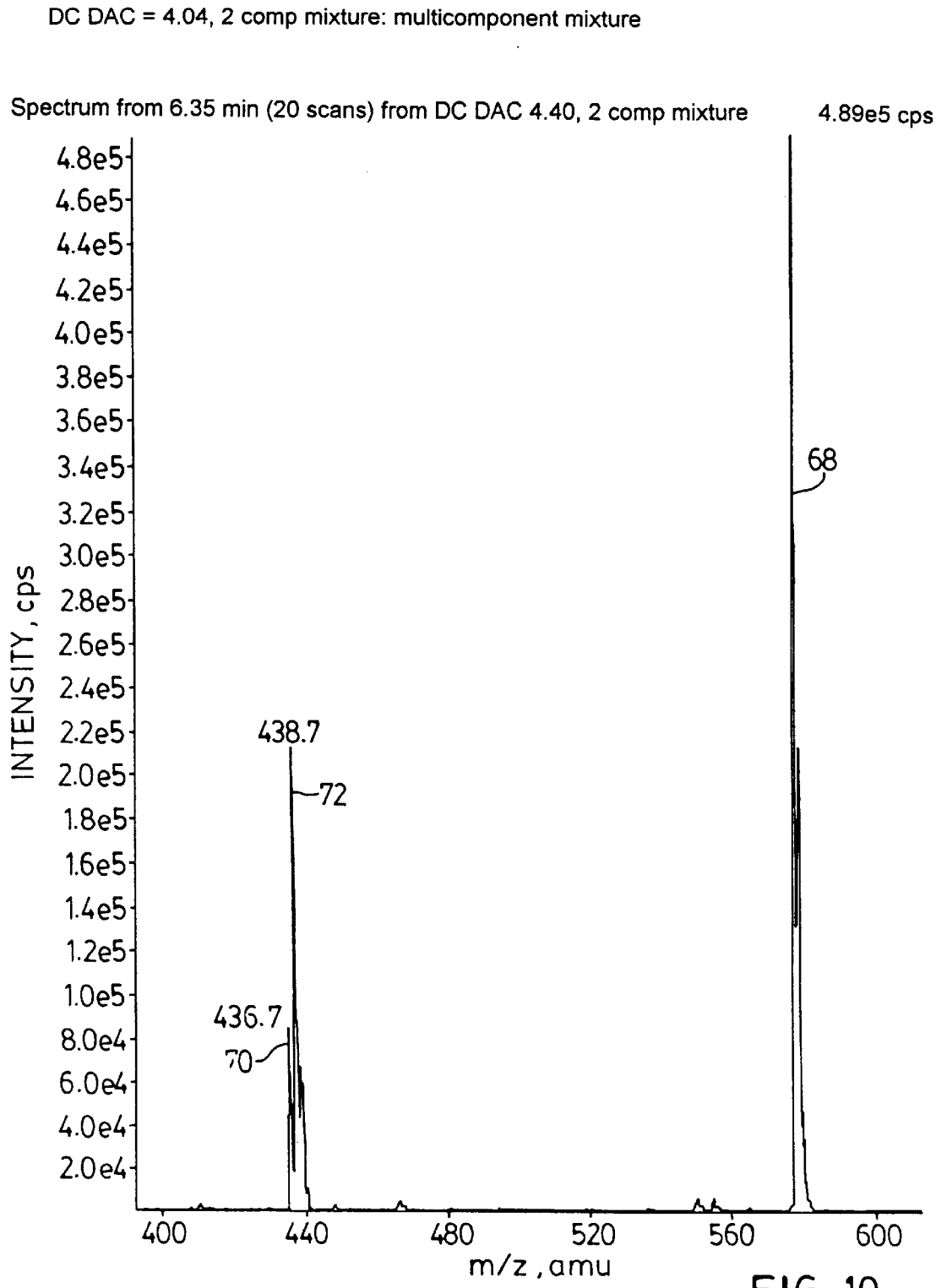
FIG. 10 shows a mass spectrum similar to that of FIG. 9 but resulting from an increase in the resolving DC applied to the Q0 rods.

An additional feature of boundary activated dissociation is that it offers a moderate amount of mass resolution. FIG. 7 shows a mass spectrum of a mixture of the two compounds tetradecyl ammonium bromide at m/z 578 and reserpine at m/z 609 obtained with no resolving DC applied to Q0. This mass spectrum shows strong spectral features 56 and 58 at the expected masses. An increase in the resolving DC voltage applied to Q0 (a linear ramp from 0 V at m/z 30 to 41 V at m/z 600 was applied) led to a dramatic reduction in the intensity of the m/z 609 reserpine peak, as shown at 62 in FIG. 8, and concurrent increase in the reserpine fragment ion features at m/z 397 and 448 as shown at 64, 66 in FIG. 9. At this level of DC there was only a minimal change in the intensity of the m/z 578 tetradecyl ammonium bromide ion (peak 56 in FIG. 7 and peak 60 in FIG. 8) indicating that the reserpine m/z 609 ion (peak 58 in FIG. 7 and peak 62 in FIG. 8) has been preferentially activated (i.e., dissociated). Further increases in the Q0 resolving DC (corresponding to a linear ramp from 0 V at m/z 30 to 46.6 V at m/z 600) result in boundary activated dissociation of the tetradecyl ammonium bromide precursor ion (peak 68 in FIG. 10) and appearance of product ions at m/z 436 and 438 as can be seen at 70 and 72 in FIG. 10. The estimated mass resolution for this example is M/ΔM ~20 which, although limited, is sufficient to separate many precursor molecular ions. Further sharpening of the β=0 stability boundary, as discussed below, is expected to increase the resolving power of Q0.

The ability to mass selectively fragment ions in the high pressure Q0 adds a new important dimension to studies that can now be conducted on single or triple quadrupole mass spectrometers (or on any other kind of mass spectrometer preceded by a high pressure linear quadrupole multiple rod array). The mass selectivity demonstrated above essentially adds an additional stage of mass spectrometry to single and triple quadrupole mass spectrometers. Thus, one can now carry out MS/MS experiments on single quadrupole instruments and $MS^3$ studies on triple quadrupole instruments using mass selective boundary activated fragmentation in Q0.

It has been found experimentally that the optimized DC resolving voltage required to induce dissociation is less than that predicted by stability diagram considerations alone. For example the DC voltage applied to obtain the spectrum in FIG. 4 results in a calculated "a" value of −0.075 for the precursor ion. However one would have expected an "a" value of about −0.098 to reach the β=0 boundary. Part of this discrepancy may be due to the fact that the RF voltage applied to Q0 is calculated from the capacitive divider network and from the drive voltage applied to Q1 and not directly measured. Therefore, there is some uncertainty as to the exact RF voltage, and thus the "q" value, in Q0. However, computer simulations have shown that the required resolving DC to induce instability is also dependent on the beam diameter at the entrance of Q0. For large beam diameters, such as those expected from the apparatus in FIG. 2, there will be a significant population of ions with large entrance radial displacements. For these ions only a small amount of resolving DC is required to induce activating collisions with the background gas (since because these ions are off the center line, little perturbation is needed to move them into a condition in which they are unstable). However this results in a spreading out of the $\beta=0$ stability boundary, causing poor resolution. Reduction of the entrance ion beam diameter is expected to reduce this boundary "fuzziness" and yield boundary activated dissociation at DC voltages closer to those calculated from stability diagram considerations. In fact for a very narrow ion beam it is expected that the $\beta=0$ boundary will be very sharp and will provide increased mass resolution within Q0.

Computer simulations have also been employed to further the understanding of the amount of energy deposited into a precursor ion as a function of the "q" value at the $\beta=0$ boundary. A hard sphere collision model has been used within a two dimensional quadrupole field with preset RF and resolving DC voltages. The initial ion beam radius as well as initial radial and axial energies are user selectable parameters. A population of 1000 ions is defined and the individual trajectories computed. At the completion of each run the average collision energy and average maximum collision energy at each "q" value is determined. The average number of collisions the ions experience prior to ejection from the quadrupole array is also reported. Fragmentation is not explicitly considered in the simulation, but the collision energies should be useful in the determination of the extent to which the precursor ion is activated. The following input information was used in the computer simulations.

m/z=609 collision cross section, $\delta=280$ $A^2$ $r_0=0.417$ cm $\Omega=1$ MHz initial ion beam radius=1.0 mm initial radial energy=0 eV initial axial energy=5 eV Pressure=8 mTorr $N_2$ The average energy results are summarized in Table 1 below, where the values reported below are averaged over the 1000 ion trajectories for each "q" value.

TABLE 1

| "q" Value | Average number of Collisions Prior to Loss | Average Collision Energy (eV) | Average Maximum Collision Energy (eV) |
|---|---|---|---|
| 0.15 | 21 | 0.4 | 1.4 |
| 0.25 | 50 | 0.7 | 3.1 |
| 0.35 | 38 | 1.3 | 5.6 |
| 0.45 | 30 | 2.0 | 8.6 |
| 0.55 | 21 | 3.2 | 13.0 |
| 0.65 | 17 | 5.5 | 20.0 |

These calculations neglect any contribution of collisional cooling which will serve to dissipate a portion of the activation energy imparted to the m/z 609 ion. Of note here is the strong dependence of collision energy on the "q" value and the fact that the maximum collision energy is always approximately 4× the average collision energy. Taken together these results indicate that boundary activation at $q>-0.3$ in the presence of a $N_2$ buffer gas will deposit sufficient energy for fragmentation. However, care must be taken to ensure that at high "q" the diameter of the ion beam entering Q0 is small, otherwise there will likely be sufficient energy from the RF field to fragment the precursor ion even at a value far away from the $\beta=0$ boundary. The result of high "q" values and large ion beam diameters will be considerably reduced mass resolution associated with the boundary activated dissociation process.

Figure 10A:
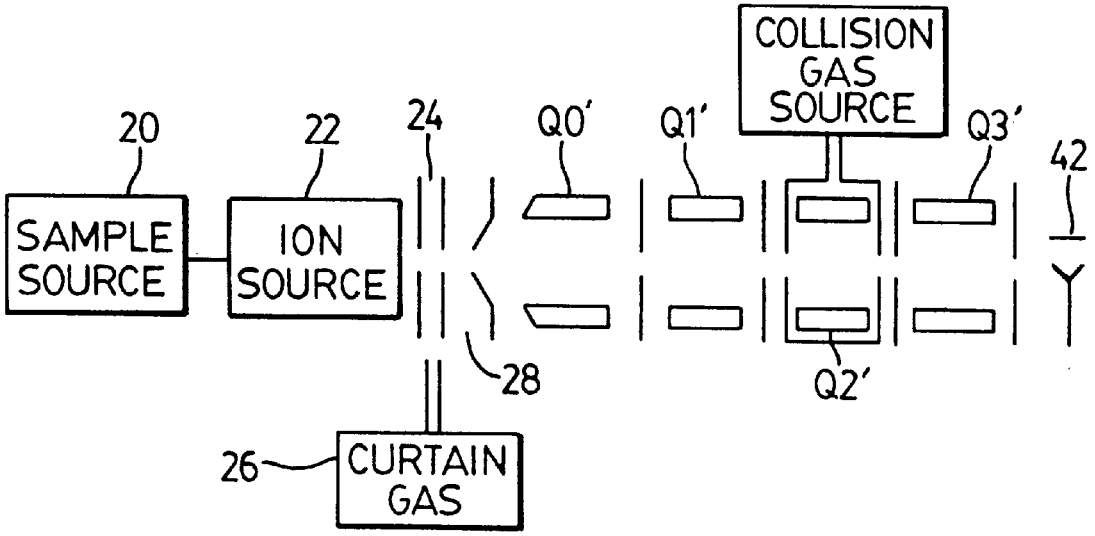
FIG. 10*a* is a diagrammatic view of a conventional triple quadrupole mass spectrometer.

Boundary activation can also be used in the collision cell region of a triple quadrupole instrument. In this arrangement, shown diagrammatically in FIG. 10*a*, an RF-only entrance quadrupole Q0' is followed by conventional resolving quadrupoles Q1', Q3', which are separated by collision cell Q2', with a detector 42 following Q3'. Q2' will be operated to produce fragmentation using boundary activated dissociation as described. There are advantages to this approach that are not immediately evident. Conventional collision cells must be relatively long to yield sufficient target gas thickness (defined as length x neutral gas number density) to effectively fragment the precursor ion. Furthermore, as is taught in U.S. Pat. No. 5,248,875, substantial length is also required to collisionally cool the unfragmented precursor ion and the product ions so that unit mass resolution across the spectrum can be achieved. Typical collision cells are on the order of 20 cm long and operated at pressures of 1–10 mTorr. The use of boundary activation in Q2 can lead to significant reductions in the length of the collision cell since the activation process occurs radially, rather than axially, and the ions are typically injected with low energies and hence do not need substantial collisional cooling. It is believed that the use of boundary activated dissociation collision cell lengths of the order of 2 to 5 cm and pressures of 2 to 10 mTorr would be sufficient to provide efficient fragmentation and transmission of the product ions to subsequent stages of mass analysis. This will result in a significant size and cost reduction of relative to current instruments. Of course, if desired a combination of conventional collision induced dissociation and boundary activated dissociation can be used in a collision cell. Since the two dissociation processes are orthogonal, they do not interfere with each other.

Ions generated by electrospray ionization techniques may enter the vacuum chamber as monomers, monomers clustered with solvent molecules, and possibly multimers with and without solvent molecules attached. Various stages of declustering are commonly used to reduce this mixture of ionic species to a larger proportion of bare monomer ions to solvated ions. Conventional declustering methodologies include employing a gas curtain as taught in U.S. Pat. No. 4,137,750 as well as collisional dissociation by acceleration of the ions through relatively high pressure regimes using voltage gradients between the orifice and skimmer and between the skimmer and Q0. While the ion acceleration techniques are useful, and often result in spectra dominated by predominantly declustered ions, they also tend to modify the charge state distribution envelope of multiply charged monomer ions. This fact severely complicates experimental studies that use the mass spectrometrically measured charge state distribution to infer some physical property of the ion in solution in the gas phase prior to entrance into the mass spectrometer.

Figure 11:
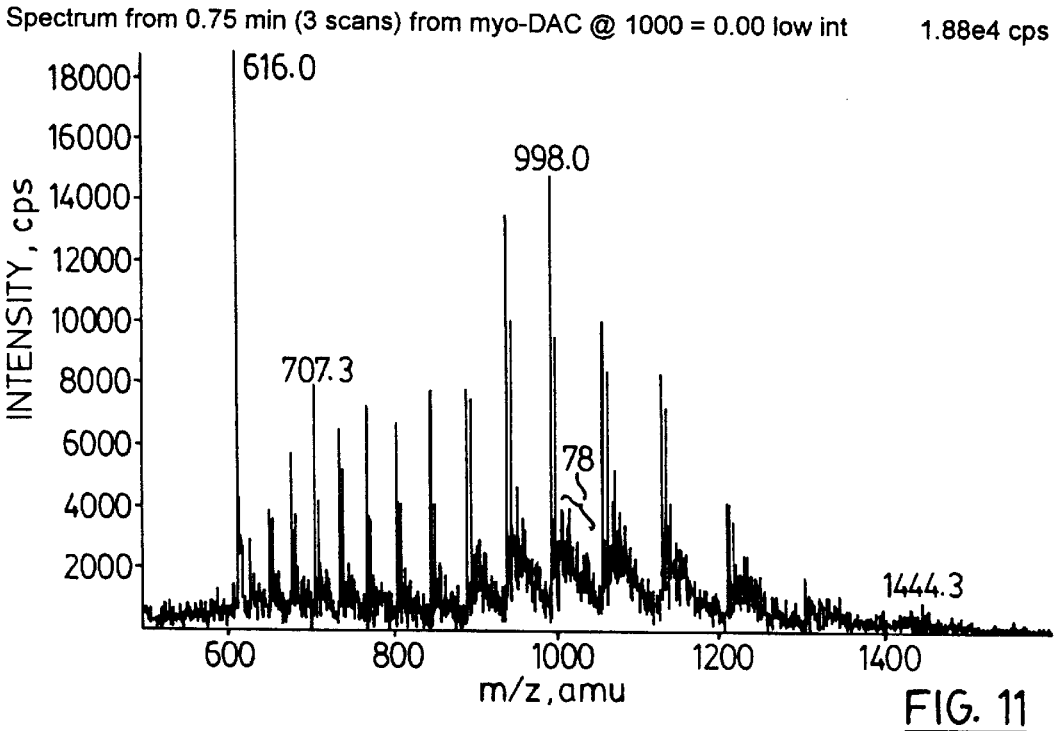
FIG. 11 shows a mass spectrum which suffers from the effects of clustering.
Figure 12:
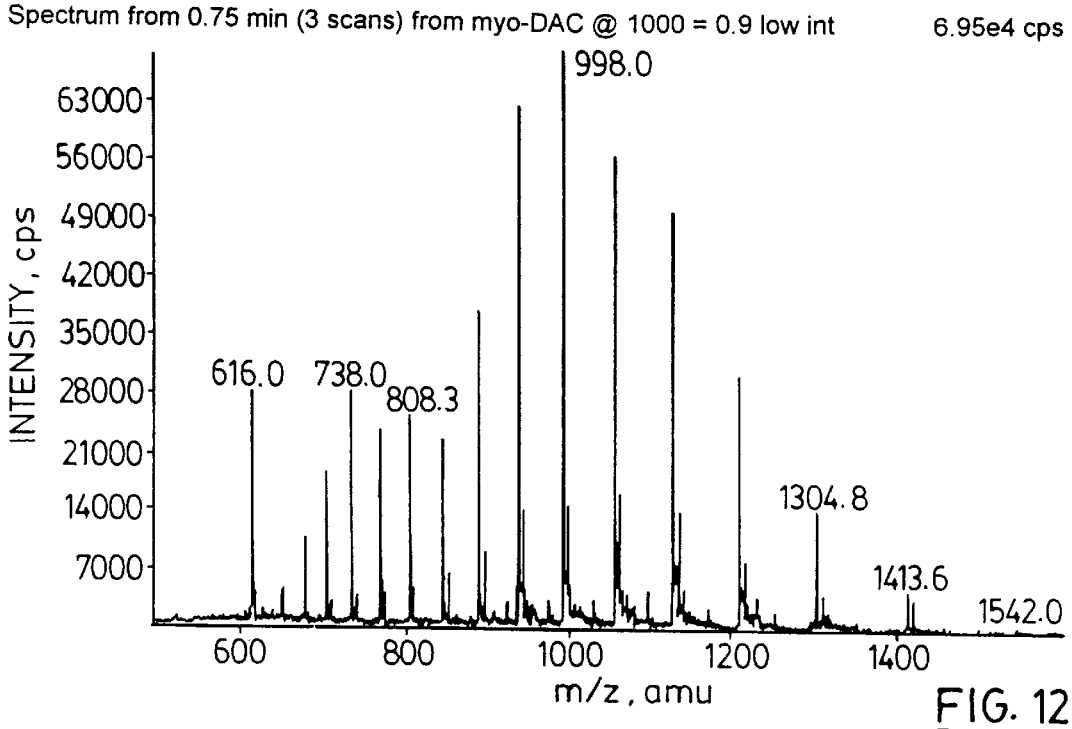
FIG. 12 shows a mass spectrum similar to that of FIG. 11 but with the effects of clustering alleviated by adding resolving DC to Q0.

Boundary activated dissociation in the high pressure Q0 region has been found to be an effective means for energizing the solvated ions toward fragmentation to bare molecular ions without disturbing the charge state distribution envelope. FIG. 11 displays the mass spectrum of apo-myoglobin obtained under low orifice and skimmer voltages and displays the characteristic multiply charged envelope. The poorly resolved structure to the high mass side of each multiply charged myoglobin feature (as indicated for example at 78 in FIG. 11) is a sign that there is significant clustering of the myoglobin ion with other solvent species. Much of this clustering can be removed by adding a moderate amount of resolving DC to Q0, and therefore inducing a moderate amount of collisional heating. FIG. 12 displays such a spectrum. Here the DC was applied as a linear ramp defined as 0 V at m/z 30 to 9.5 V at m/z 1000. The enhancement in the spectral quality of FIG. 12 relative to that in FIG. 11 is significant. The monomer ion intensity has increased by about 3.5×, the contribution of ionic clusters to the spectrum has been reduced, and the overall spectral signal-to-noise is considerably increased. Another important point is that the multiply charged envelope has not been changed by the addition of boundary activation in Q0.

Figure 13:
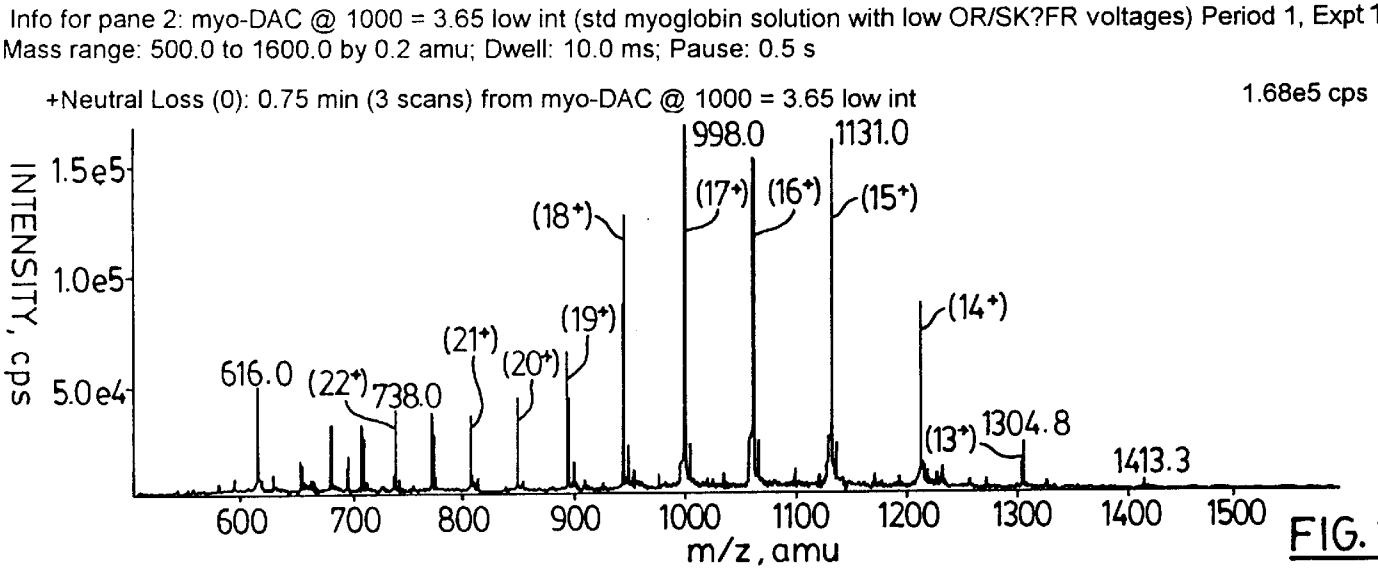
FIG. 13 shows a further mass spectrum similar to that of FIG. 11 but with additional resolving DC applied to the Q0 rods.
Figure 14:
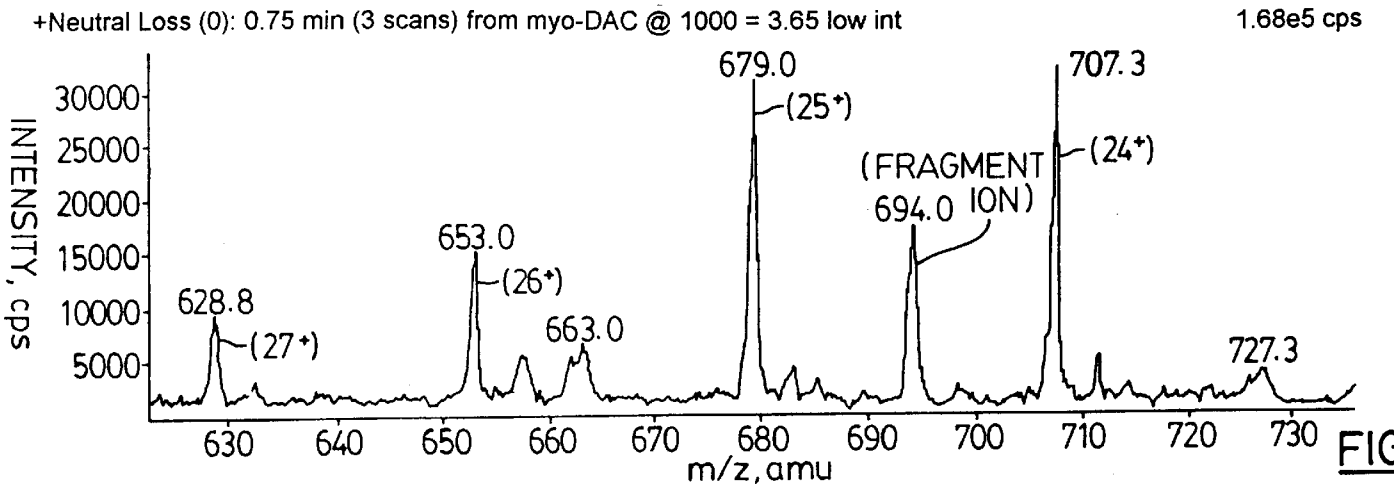
FIG. 14 shows a mass spectrum similar to that of FIG. 13 but with additional resolving DC applied to the Q0 rods as compared with FIG. 11.

Further increases in Q0 resolving DC (corresponding to a linear ramp from 0 V at m/z 30 to 38.6 V at m/z 1000) lead to the appearance of the characteristic fragment ion peaks at m/z 694 and 726 as well as many others as is seen in FIGS. 13 and 14. Again however note that even under these relatively strong boundary activation conditions the multiply charged envelope has remained largely unchanged. (The numbers of charges for various peaks are marked in parentheses in FIGS. 13 and 14.)

Figure 16:
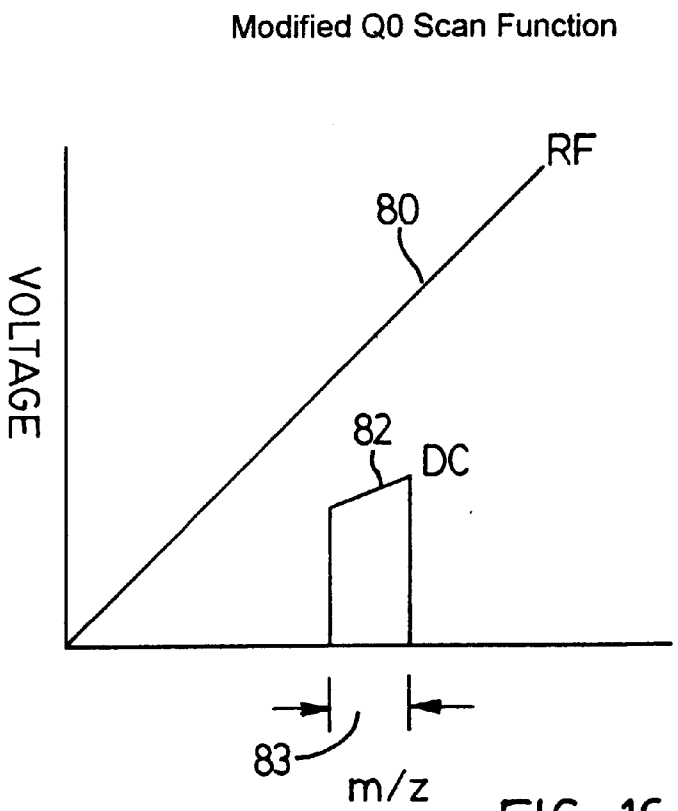
FIG. 16 is a graph similar to that of FIG. 15 but showing the application of resolving DC over only a part of the mass spectrum.
Figure 15:
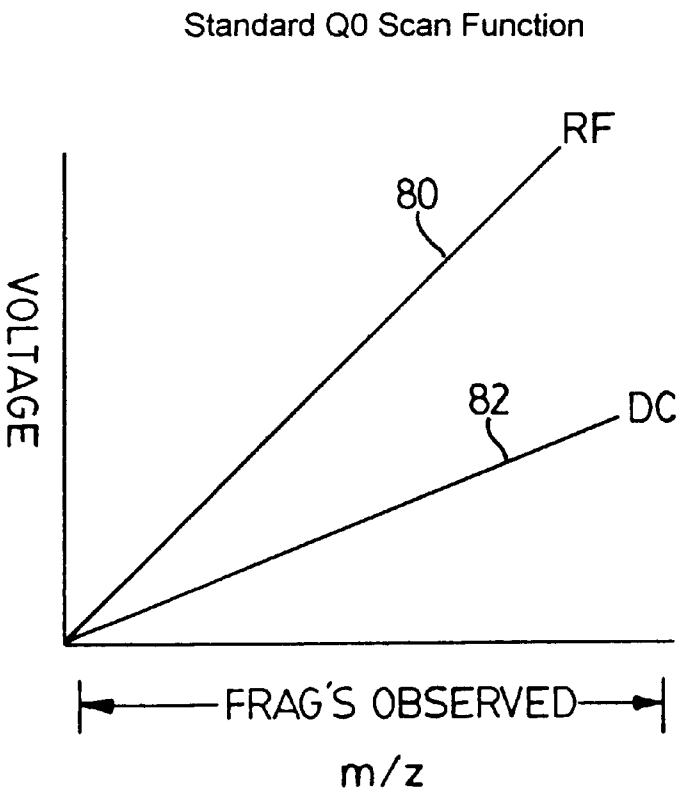
FIG. 15 is a graph showing the scanning of resolving DC with RF on the Q0 rods, over the complete mass spectrum.

Reference is next made to FIGS. 15 and 16, which show RF and resolving DC voltages 80, 82 applied to Q0 as these voltages are scanned with time. FIG. 15 shows the DC scanned with RF over the entire spectrum and will yield (for appropriate RF voltages) product ions over the entire scanned range, as previously discussed. However in FIG. 16, the DC voltage 82 is scanned only over m/z portion or interval 83, and will yield fragment ions (by boundary activated dissociation) only over the mass range for which the DC is applied. Using this technique, fragmentation information can be obtained within a pre-specified mass region of the spectrum. The remainder of the spectrum will be comprised of spectral features of the unfragmented precursor ions when a continuous ion source such as an electrospray source is used.

Figure 17:
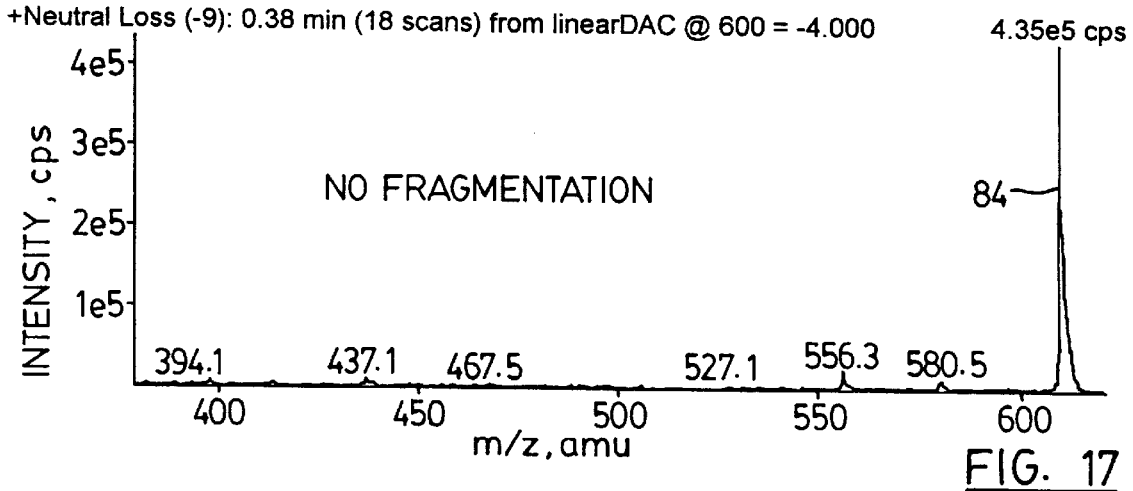
FIG. 17 shows a mass spectrum in which the resolving DC applied to the Q0 rods is linearly ramped with mass but is insufficient to cause boundary activated dissociation.
Figure 18:
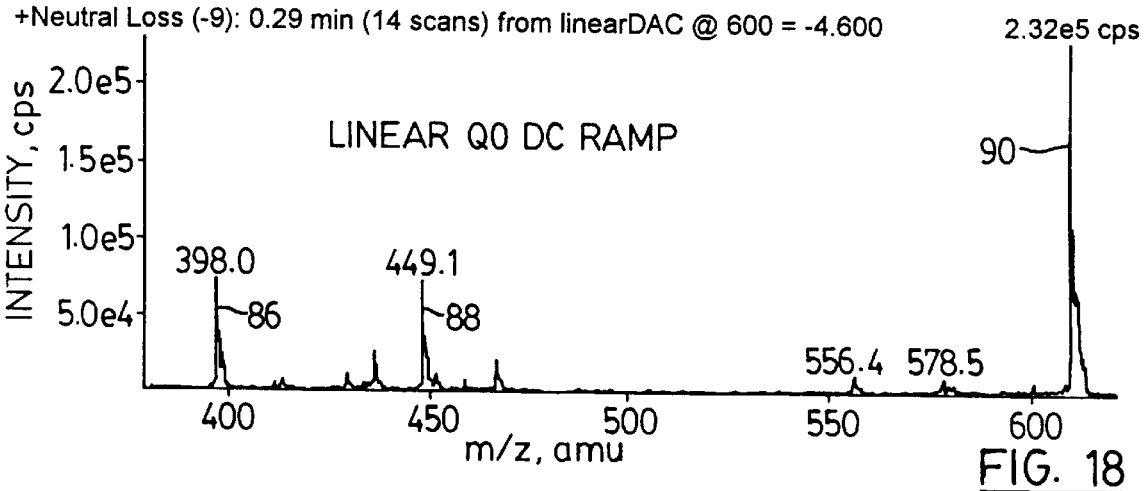
FIG. 18 shows a mass spectrum similar to that of FIG. 17 but with the resolving DC voltage increased sufficiently to observe boundary activated dissociation product ions.
Figure 19:
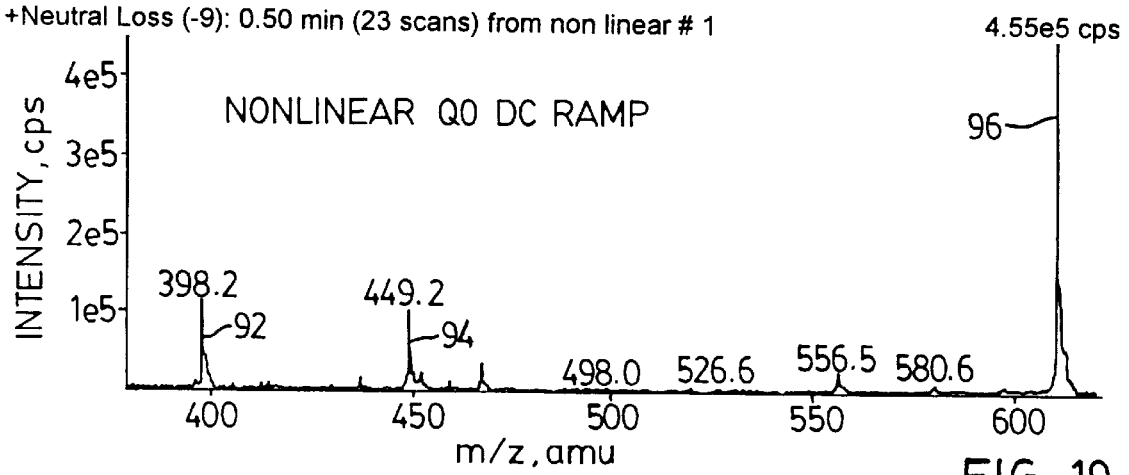
FIG. 19 shows a mass spectrum resulting from a modified non linear scan of the resolving DC applied to the Q0 rods.

An example showing the results of this technique is displayed in FIGS. 17, 18 and 19. FIG. 17 shows the single quadrupole mass spectrum of reserpine in which the resolving DC applied to Q0 is linearly ramped with mass but is insufficient to move the precursor ion at m/z 609 to the $\beta=0$ boundary. (The ramp was from 0 V DC at m/z 30 to 21.9 V DC at m/z 600.) This spectrum is equivalent to a conventional single quadrupole mass spectrum of reserpine, with reserpine at m/z 609 indicated at 18.

FIG. 18 shows a mass spectrum again obtained with a linear ramp of the Q0 resolving DC voltage (as indicated in FIG. 15), but here the DC voltage has been increased corresponding to a ramp of 0 V DC at m/z 30 to 25.2 V DC at m/z 600. Here, boundary activated dissociation product ions are observed, depicted at 86, 88 in FIG. 18. There is also an associated decrease in the precursor ion intensity at mass 609 (shown at 90 in FIG. 18) of approximately two times.

FIG. 19 shows the results of a modified non linear scan of the DC applied to Q0. Here sufficient Q0 DC voltage to induce boundary activated dissociation was applied while Q0 was transmitting the product ions in the m/z 380 to m/z 480 region (corresponding to the technique shown in FIG. 16). During this portion of the spectrum, a DC ramp corresponding to that used for FIG. 18 was employed. Above m/z=480, the DC was returned to a low value so that higher m/z species were well within the stability region and thus were not fragmented within Q0. (The scan did not go below about m/z 380.) The result of this technique is the appearance of intense fragment ion spectral features in the m/z 380 to 480 region (indicated at 92, 94 in FIG. 19), and since the ion source of the instrument provides a continuous stream of ions into Q0, the appearance of unfragmented precursor ions at m/z 609 (indicated at 96 in FIG. 19), at an intensity corresponding to that of peak 84 of FIG. 17.

The scan function described in connection with FIGS. 16 and 19 allows the possibility of mass selective targeted fragmentation over a predetermined region of the mass scan while maintaining intense unfragmented precursor ion features outside of this mass spectral region. This serves to enhance the signal-to-noise ratio of the precursor ions while providing specific MS/MS information in the m/z region of interest. Such scanned functions are not currently possible in conventional single or triple quadrupole mass spectrometers.

The scanned function described in connection with FIGS. 16 and 19 can also be achieved by ramping the resolving DC over the entire spectrum and lowering the RF to a suitable level over those parts of the spectrum where no boundary activated dissociation is desired. However, since the collision energy is a function of the RF voltage squared, this method may be more difficult to operate than the method of FIGS. 16 and 19.

It will also be seen that even without the scan function described in connection with FIGS. 16, 19, boundary activation within a high pressure quadrupole still provides an additional stage of moderate mass resolution which may be used to obtain MS/MS information from a single quadrupole mass spectrometer and MS/MS/MS information using a triple quadrupole instrument. It will also be realized, as discussed, that the boundary activation technique allows the use of shorter collision cells, resulting in significant size and cost reduction of triple quadrupole mass spectrometers. The method also provides a way of varying the internal energy deposited into an ionic species, allowing efficient declustering of heavily clustered precursor ions of the type often produced by electrospray ionization techniques. In this application, the amount of energy deposited is less than that required to fragment the bare precursor ion, but is sufficient to remove adducted species from the clustered precursor ion. This results in simpler and more readily interpretable mass spectra.

While preferred embodiments of the invention have been described, it will be appreciated that various changes may be made within the scope and spirit of the invention.

I claim:

1. A method of operating a rod type mass spectrometer comprising: introducing precursor ions into said mass spectrometer, providing a collision gas therein to limit the mean free path of said precursor ions, applying RF and resolving DC voltages to said mass spectrometer to operate said mass spectrometer near the $\beta=0$ boundary for said precursor ions, thereby inducing boundary activated dissociation of at least some of said precursor ions to produce fragment ions, and detecting at least some of said fragment ions.

2. A method according to claim 1 and including the step of ejecting ions from said rod type mass spectrometer axially, and directing at least some of the ejected ions into another mass spectrometer for identification.

3. A method according to claim 1 or 2 and including the step of fragmenting said precursor ions over only a selected portion of the mass spectrum, and leaving the precursor ions unfragmented over the remainder of the mass spectrum.

4. A method according to claim 1 or 2 and including the step of applying resolving DC to fragment said precursor ions over only a selected portion of the mass spectrum and leaving the precursor ions unfragmented over the remaining portion of the mass spectrum.

5. A method according to claim 1 or 2 and including the step of mass selecting in said mass spectrometer the precursor ions to be fragmented.

6. A method according to claim 1 or 2 wherein said precursor ions comprise parent ions clustered with solvent molecules and said method comprises applying RF and resolving DC to said mass spectrometer sufficient to remove said solvent molecules without substantially fragmenting said parent ions.

7. A method according to claim 1 wherein said mass spectrometer is operated as a collision cell between first and second resolving mass spectrometers.

8. A method according to claim 7 wherein said collision cell is of a length between about 2 and 5 cm and has a pressure therein of said gas of between 2 and 10 mTorr.

9. A method according to claim 7 and including the step of injecting said precursor ions into said collision cell with axial energy sufficient to produce some collision induced dissociation of said precursor ions, so that said fragment ions are produced both by collision induced dissociation and by boundary activated dissociation.

* * * * *